US011235905B2

(12) United States Patent
Su

(10) Patent No.: US 11,235,905 B2
(45) Date of Patent: Feb. 1, 2022

(54) FRAME AND PALLET COAMING BOX

(71) Applicant: SHANGHAI HONGYAN RETURNABLE TRANSIT PACKAGINGS CO., LTD, Shanghai (CN)

(72) Inventor: Yongping Su, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 0 days.

(21) Appl. No.: 15/777,563

(22) PCT Filed: Nov. 18, 2016

(86) PCT No.: PCT/CN2016/106433
§ 371 (c)(1),
(2) Date: May 18, 2018

(87) PCT Pub. No.: WO2017/084620
PCT Pub. Date: May 26, 2017

(65) Prior Publication Data

US 2018/0362211 A1 Dec. 20, 2018

(30) Foreign Application Priority Data

Nov. 20, 2015 (CN) ..... 201510816141.5

(51) Int. Cl.
*B65D 19/06* (2006.01)
*B65D 21/08* (2006.01)

(52) U.S. Cl.
CPC ..... *B65D 19/06* (2013.01); *B65D 21/083* (2013.01); *B65D 2519/00333* (2013.01);
(Continued)

(58) Field of Classification Search
CPC ..... B65D 19/06; B65D 21/083; B65D 7/26; B65D 88/524; B65D 88/522;
(Continued)

(56) References Cited

U.S. PATENT DOCUMENTS 4,828,132 A 5/1989 Francis et al.
4,944,404 A * 7/1990 Mead ..... B65D 19/06 206/600
5,593,046 A * 1/1997 Katsuura ..... H05K 7/1424 211/41.15

FOREIGN PATENT DOCUMENTS

CN 2405872 Y 11/2000
CN 203020651 U 6/2013
(Continued)

OTHER PUBLICATIONS

International Search Report and Written Opinion, International Patent Application No. PCT/CN2016/106433, dated Jan. 23, 2017, with English translation of Search Report (10 pages).
(Continued)

*Primary Examiner* — Anthony D Stashick
*Assistant Examiner* — L Kmet
(74) *Attorney, Agent, or Firm* — Hamre, Schumann, Mueller & Larson, P.C.

(57) ABSTRACT

A frame and a pallet coaming box, the frame (100) comprising: two long side plates (10) and two groups of short side plates (20) opposite thereto, each group of short side plates (20) comprising two short side plates (21, 22), wherein the two short plates (21, 22) are capable of being folded over each other, and the long side plates (10) and the short side plates (21, 22) that are next to each other are capable of being folded over one another; one of the two short side plates (21, 22) being provided with at least one first engaging portion (211), and the other short side plate being provided with a second engaging portion (221) match-
(Continued)

ing the first engaging portion; a locking device (30) being further arranged between the two short side plates (21, 22), the locking device (30) comprising an operating member (31), a locking member (32), and a locking structure (33) matching the locking member (32); the locking member (32) being mounted on a short side plate (21, 22), the locking structure (33) being arranged on the other short side plate (21, 22), and the operating member (31) operatively driving the locking member (32) to mutually lock or separately unlock with the locking structure (33) so as to lock or unlock the two short side plates (21, 22). The frame minimizes outward deformation of side plates caused by engagement, and improves stability of containers during loading, transporting or stacking.

10 Claims, 14 Drawing Sheets

(52) U.S. Cl.
CPC ..... *B65D 2519/00422* (2013.01); *B65D 2519/00502* (2013.01); *B65D 2519/00522* (2013.01); *B65D 2519/00532* (2013.01); *B65D 2519/00601* (2013.01); *B65D 2519/00611* (2013.01); *B65D 2519/00641* (2013.01); *B65D 2519/00915* (2013.01)

(58) Field of Classification Search
CPC .... B65D 11/1846; B65D 11/18; B65D 19/12; E05D 2005/106; Y10T 16/54028; Y10T 16/54044; Y10T 16/54035; Y10T 16/54038; Y10T 16/557
USPC ..... 206/600
See application file for complete search history.

(56) References Cited

FOREIGN PATENT DOCUMENTS

| | | | |
|---|---|---|---|
| CN | 105438594 | A | 3/2016 |
| DE | 4415638 | A1 | 11/1995 |
| EP | 0218320 | A1 | 4/1987 |
| EP | 2500290 | A1 | 9/2012 |
| FR | 2102885 | A6 | 4/1972 |
| JP | 2008308194 | A | 12/2008 |
| JP | 2009023709 | A | 2/2009 |

OTHER PUBLICATIONS

The extended European search report issued in DE16865797.1, dated May 9, 2019, 8 pages provided.

* cited by examiner

C

D

FRAME AND PALLET COAMING BOX

FIELD

The present application relates to a logistics transportation unit, in particular to a frame and a pallet coaming box.

BACKGROUND

The existing large-scale folding containers generally have specifications such as 1200×1000×1000 and 1220×1220×1170, and so on. Their sizes are relatively large. In order to be suitable for loading different kinds of cargos and different heights and to be easy taking cargos out containers, and the height of the containers to be flexibly adjusted according to the needs of the height of the side plates of the containers, the long and short side plates are usually connected to be foldable inwards to form a flat structure, and to be unfoldable outwards to form a roughly rectangular container that is used as a unit. When loading more cargo capacity, this unit can be stacked upwards again, stacking four to five layers in order to get more volume. However, the side plates of the existing container are hinged in a single manner, and the hinge joint between the short side plates is not effectively locked, so that the short side plates are weak in resistance to deformation due to external forces or cargo tension, which will not only cause hidden dangers in the transport of goods, but also result in the lack of an effective stacking limit for the units superimposed on the upper floors. The reliability of the containers is low.

Taking the EP2500290A1 and EP0218320A1 two patents as examples, the hinge of the short side plates are achieved by separated hinge shaft and hinge part, ie, the independent hinge shaft cooperates with the hinge link or the hinge axis integrated with the side plate cooperates with the separated link, and during the folding operation, they are deformed to evade through the elasticity of the plastic itself. At the same time, during the unfolding of the container, the inner wall of the container is easily deformed due to the tension of the goods, and even the plastic hook is detached. The stacking on the container is also lack of effective support and limitations, so that the container has a large potential safety hazard, easy to be damaged and inconvenient to use.

SUMMARY

The object of the present invention is to provide a frame to solve the problems existing in the above background art.

In order to solve the above problems, according to one aspect of the present invention, a frame is provided. The frame comprises two long side plates and two groups of short side plates opposite thereto, each group of short side plates comprising two short side plates, the two short side plates are capable of being folded over each other, and the long side plates and the short side plates that are next to each other are capable of being folded over one another, wherein one of the two short side plates is provided with at least one first engaging portion, and the other of the two short side plates is provided with a second engaging portion matching the first engaging portion, and a locking device comprising an operating member, a locking member, and a locking structure matching the locking member is further provided between the two short side plates, wherein the locking member is mounted on one of the short side plates, the locking structure is provided on the other one of the short side plates, and the operating member operatively drives the locking member to mutually lock or separately unlock with the locking structure so as to lock or unlock the two short side plates.

Preferably, one of the two short side plates is provided with a plurality of the first engaging portions spaced apart from one another, and the other of the two short side plates is provided with a plurality of the second engaging portions; a hinge mounting portion is provided between the second engaging portions, and the hinge mounting portion is inserted between two first engaging portions, and the locking member is provided at the same height as the second engaging portions.

Preferably, the locking member is a locking tongue, the locking structure is a locking hole, and the operating member operatively drives the locking tongue to extend into or exit from the locking hole, so as to lock or unlock the two short side plates.

Preferably, the operating member and the locking member are integrally formed.

Preferably, the front end of the first engaging portion is provided with a first inclined surface, and the front end of the locking tongue is provided with a second inclined surface that cooperates with the first inclined surface, and when the two short side plates moves from the folded state to the unfolded state, the locking tongue can freely move into the locking hole through the cooperative guiding action of the first inclined surface and the second inclined surface.

Preferably, the two short side plates include a first short side plate and a second short side plate, wherein the first engaging portion and the locking hole are provided on the first short side plate, and the second engaging portion is provided on the second short side plate, and the operating member is movably mounted on the second short side plate.

Preferably, a recess is provided on an inner side of the second short side plate, and the second engaging portion is provided in the recess and extend integrally toward inside of the frame from the recess, and a locking tongue mounting hole is formed on a side wall of the recess facing the first short side plate.

Preferably, the first short side plate and the second short side plate are connected by a hinge, and a plurality of locking tongue mounting hole are provided along height direction of the second short side plate, and a hinge mounting portion is provided between each two of the tongue mounting holes.

Preferably, an opening is provided on the first short side plate to cooperate with the hinge mounting portion, and a first hinge hole is provided at the bottom of the first engaging portion, and a second hinge hole is provided on the hinge mounting portion, and the hinge includes a first hinge shaft and a second hinge shaft, wherein the first hinge shaft is rotatably mounted in the first hinge hole, and the second hinge shaft is rotatably mounted in the second hinge hole.

Preferably, after the first short side plate and the second short side plate are connected by the hinge, the hinge and the operating member are located within the outer surface of the first short side plate and the second short side.

Preferably, the operating member is integrally formed with the locking tongue, and the operating member comprises lugs and a return spring disposed behind the locking tongue, and the second short side plate is provided with lug mounting holes that cooperates with the lugs; the operating member and the locking tongue are mounted on the second short side plate by snapping the lugs into the lug mounting holes and inserting the locking tongue into the tongue mounting hole.

Preferably, each of two ends of the operating member are provided with a protrusion respectively and the second short side plate is provided with a baffle, and when the operating member is installed on the second short side plate, the baffle restricts the operating member in a direction perpendicular to the second short side plate.

Preferably, the operating member further includes a handle, and both ends of the handle are provided with a limiting portion, and an end surface of the limiting portion is provided with a rotating shaft; the second short side plate is provided with a shaft mounting hole for accommodating the rotating shaft, and the side of the operating member integrally protrudes two protruding blocks provided with a sliding slot matched with the limiting portion, so that the locking tongue is rotationally driven by the handle through cooperation of the rotating shaft and the sliding slot.

Preferably, the operating member further includes a return spring, and the return spring is disposed behind the locking tongue.

Preferably, the operating member is provided with lugs and the first short side plate is provided with lug mounting holes that is cooperated with the lugs, and the lugs are inserted into the lug mounting hole so as to mount the locking tongue on the second short side plate.

Preferably, the adjacent long side plate and the short side plate are connected by a second hinge, which comprises a long side plate hinge shaft provided on the long side plate and hooks and protrusions provided on the short side plate; upper end portion of the long side plate hinge shaft has a side surface including a curved portion and a planar portion, and when the long side plate is perpendicular to the short side plate, the planar portion is perpendicular to end of the protrusions, and when the long side plate is folded relative to the short side plate, the planar portion is parallel to the end of the protrusions, and the hook is used to cooperate with side surface of the long side plate hinge shaft.

According to another aspect of the present invention, a pallet coaming box is provided. The pallet coaming box comprises a pallet and the above frame, wherein the frame is mounted on the pallet.

The frame of the present invention is provided with unlocking devices which may be manually operated at the hinges of two short side plates. When the frame is unfolded and used, the adjacent short side plates can be kept relatively parallel to minimize the deformation of the side plates which are subjected to the tension of the goods, and also increase the effectiveness and reliability of the support and limit when another frame is stacked thereon. During use, the side plates are easy to fold, and the engaging portion of the short side plate can effectively limit the displacement of the side plates when being unfolded, so as to minimize the outwards deformation of the side plates due to the seizure, and improve the reliability of container for loading and transportation or stacking on one another.

DETAILED DESCRIPTION

Figure 1:
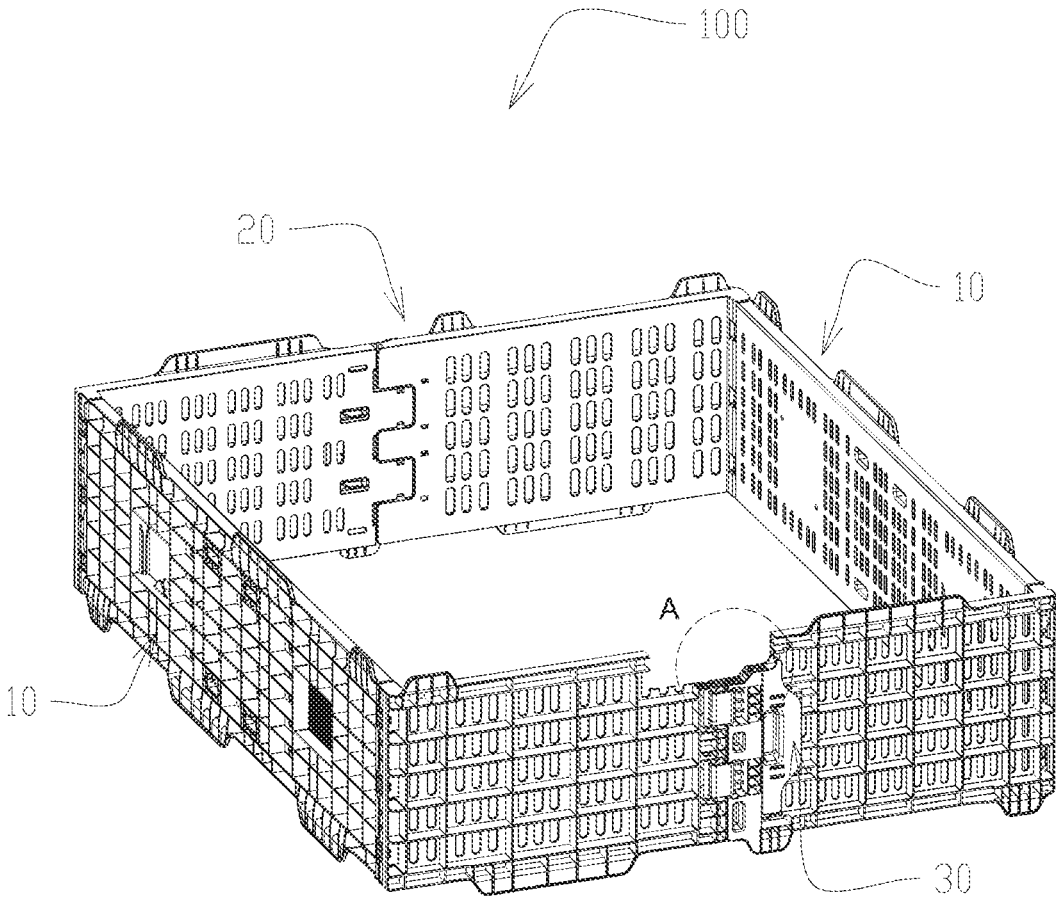
FIG. 1 is a perspective view of a frame in an unfolded state according to an embodiment of the present invention.

Hereinafter, preferred embodiment of the present invention will be described in detail with reference to the drawings, so that the purposes, features and advantages of the present invention will be more clearly understood. It should be understood that the embodiments shown in the drawings are not to limit the scope of the invention, but merely to illustrate the true spirit of the technical solutions of the present invention.

The frame of the present application generally comprises two long side plates and two groups of short side plates opposite thereto, and each group of short side plates comprises two short side plates, wherein the two short side plates are capable of being folded over each other, and the long side plates and the short side plates that are next to each other are capable of being folded over one another. One of the two short side plates is provided with at least one first engaging portion, and the other short side plates is provided with a second engaging portion matching the first engaging portion. A locking device comprising an operating member, a locking member, and a locking structure matching the locking member is further arranged between the two short side plates, wherein the locking member is mounted on a short plate, and the locking structure is disposed on another short plate and the operating member operatively drives the locking member to mutually lock or separately unlock with the locking structure so as to lock or unlock the two short side plates.

One embodiment of the present invention will be described in detail below with reference to FIGS. 1-6.

Figure 2:
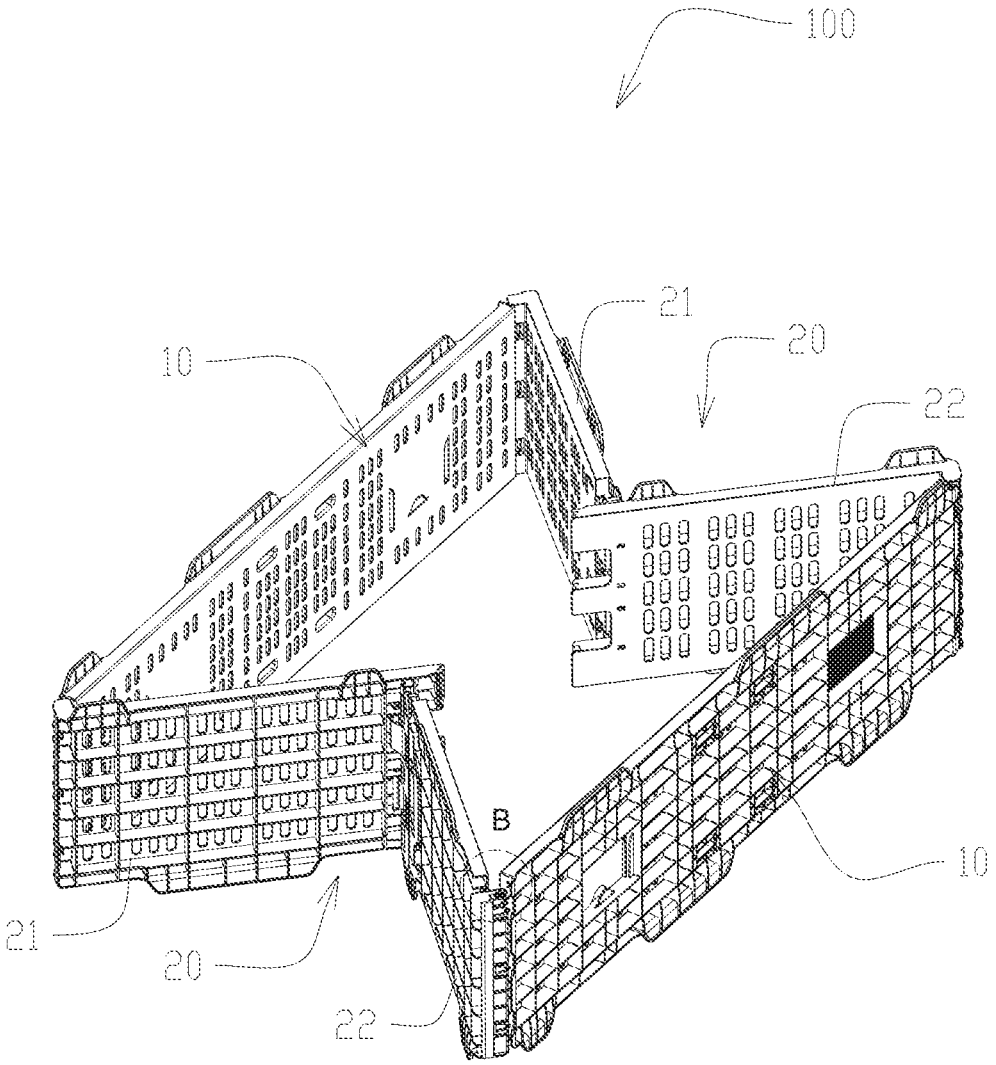
FIG. 2 is a perspective view of a frame in a folding process according to an embodiment of the present invention.
Figure 3:
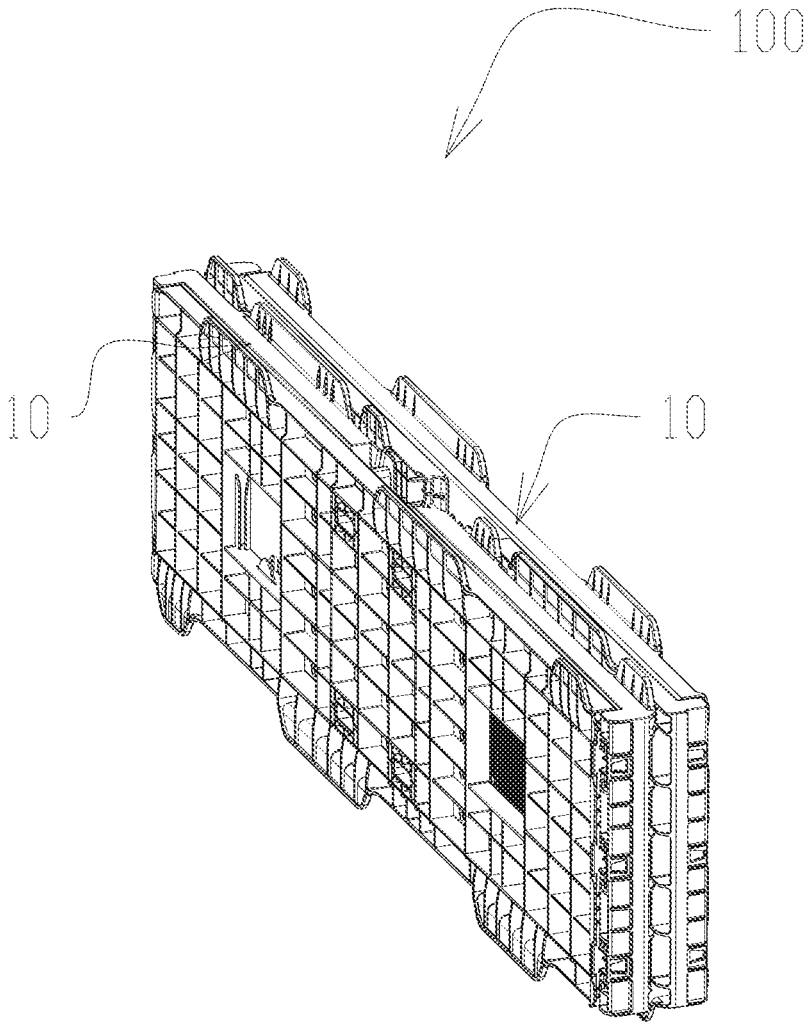
FIG. 3 is a perspective view of a frame in a folded state according to an embodiment of the present invention.

FIG. 1 is a perspective view of a frame 100 in an unfolded state according to an embodiment of the present invention. FIG. 2 is a perspective view of the frame 100 in a folding process according to an embodiment of the present invention. FIG. 3 is a perspective view of the frame 100 in a folded state according to an embodiment of the present invention.

As shown in FIGS. 1-3, the frame 100 of the present invention includes two opposing long side plates 10 and two opposing groups of short side plates 20. Each group of short side plates 20 includes two short side plates 21, 22. The two short side plates 21, 22 belonging to the same group can be folded over each other, and the long side plate 10 and the short side plate 21 or the long side plate 10 and the short side plate 22 in adjacent positions can be folded with each other.

Figure 4:
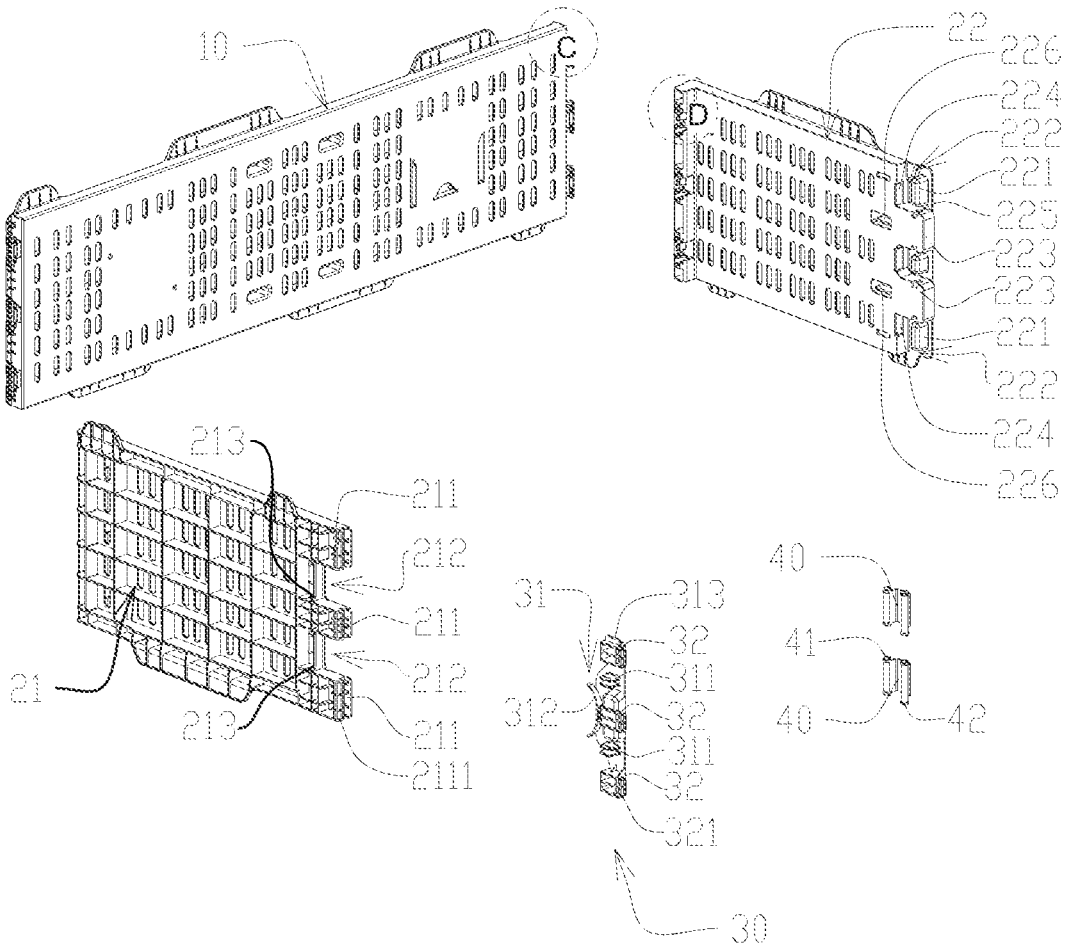
FIG. 4 is an exploded perspective view of a frame according to an embodiment of the present invention.
Figure 5:
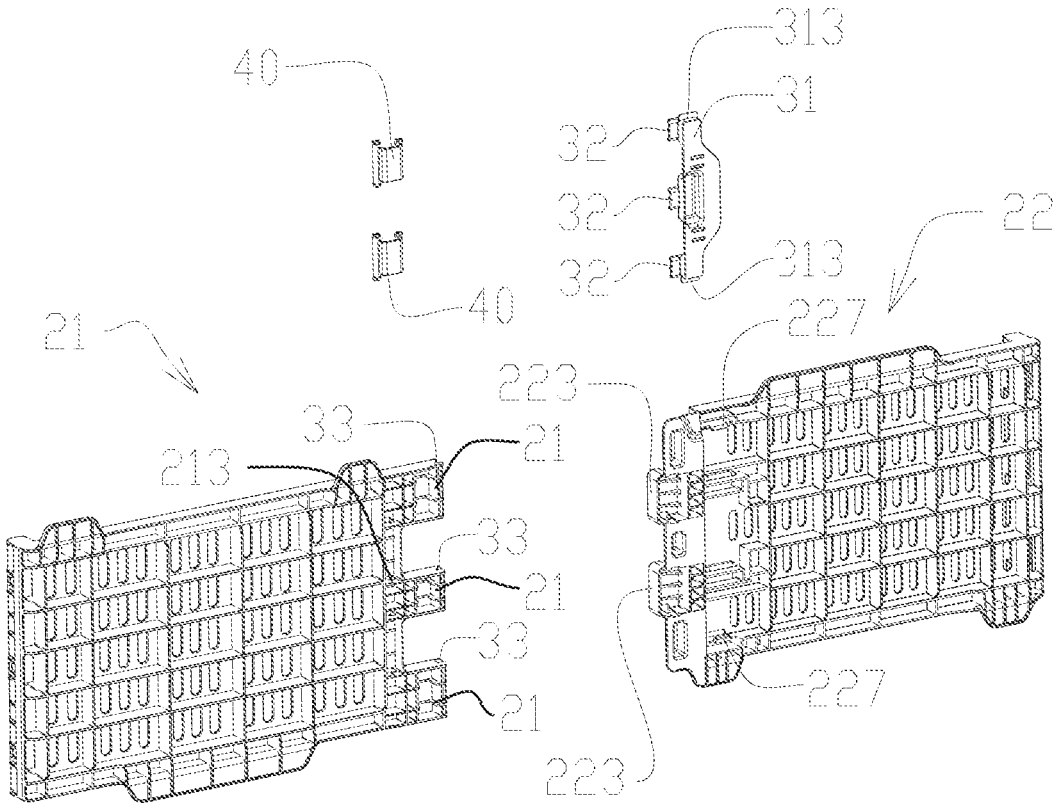
FIG. 5 is an exploded perspective view of a group of short side plates according to an embodiment of the present invention.

FIG. 4 is an exploded perspective view of a long side plate 10 and a group of short side plates 20, and FIG. 5 is an exploded perspective view of a group of short side plates 20. As shown in FIGS. 4-5, a plurality of first engaging portions 211 are disposed on the short side plate 21, and a plurality of second engaging portions 221 engaged with the first engaging portions 211 are disposed on the short side plate 22. A locking device 30 is further provided between the short side plates 211 and 221.

The locking device 30 includes an operating member 31, a locking member 32, and a locking structure 33 that cooperates with the locking member 32. In this embodiment, the locking member 32 is a locking tongue, and the locking structure 33 is a locking hole, wherein the locking tongue 32 is integrally formed with the operating member 31 and is mounted on the short side plate 22. The locking hole 33 is disposed on the short side plate 21(as shown in FIG. 5, in this embodiment, the locking hole 33 is specifically disposed on the first engaging portion 211), and the operating member 31 can be operated to bring the locking tongue 32 to engage into the locking hole 33 or withdraw from locking hole 33 to lock or unlock the short side plates 21, 22.

As shown in FIGS. 4-5, the first engaging portions 211 integrally protrude from the short side plate 21 to the short side plate 22. An opening 212, which is used to cooperate with a hinge mounting portion 223 provided on the short side plate 22, is provided between the first engaging portions 211. In particular, when the first engaging portion 211 and the second engaging portion 221 are engaged with each other, the hinge mounting portion 223 protrudes into the opening 212. A first hinge hole 213 is provided at the bottom of the first engaging portion 21, and the first hinge hole 213 is used to mate with the hinge 40, which will be described in detail below.

Front end of the first engaging portion 211 is provided with a first inclined surface 2111, and front end of the locking tongue 32 is provided with a second inclined surface 321 that is matched with the first inclined surface. When the two short side plates 21, 22 are moved from the folded state to the unfolded state, the locking tongue 32 can freely extend into the locking hole 33 through the cooperative guiding action of the first inclined surface 2111 and the second inclined surface 321.

A recess 222 is formed in the inner side of the second short side plate 22, and the second engaging portion 221 is disposed in the recess 222 and integrally protrudes from the recess 222 into the inside of the frame. When the short side plate 21 and the short side plate 22 mutually engage with each other, the second engaging portion 222 is engaged in the first engaging portion 211 in a direction perpendicular to the short side plate 21. A locking tongue mounting hole 224, which is used to receive the locking tongue 32, is provided on the sidewall of the recess 222 facing the short side plate 21. This will be described in detail below.

A hinge mounting portion 223 is provided between the second engaging portions 221. When the first engaging portion 211 and the second engaging portion 221 are engaged with each other, the hinge mounting portion 223 is inserted between two first engaging portions 211 (i.e., in the opening 212). The locking tongue 32 is disposed in the locking tongue mounting hole 224. The locking tongue mounting hole 224 has the same height as the second engaging portion 221. The hinge mounting portion 223 is provided with a second hinge hole 225, which engages with the hinge 40, so that the short side plate 21 and the short side plate 22 are connected through the hinge 40.

As shown in FIG. 4, the hinge 40 includes a first hinge shaft 41 and a second hinge shaft 42. The first hinge shaft 41 is rotatably mounted in the first hinge hole 213, and the second hinge shaft 42 is rotatably mounted in the second hinge hole 225.

As shown in FIGS. 4-5, the operating member 31 includes lugs 311 and a return spring 312. The return spring 312 is disposed behind the locking tongue 32. The second short side plate 22 is provided with lug mounting holes 226 that match with the lugs 311. The operating member 31 and the locking tongue 32 are mounted on the second short side plate 22 by snapping the lugs 311 into the lug mounting holes 226 and inserting the locking tongue 32 into the locking tongue mounting hole 224.

In this embodiment, each of the two ends of the operating member 31 is provided with a protrusion 313. The second short side plate is provided with a baffle 227. When the operating member 31 is mounted on the second short side plate 22, the operating member 31 is stopped by the baffle 227 in a direction perpendicular to the second short side plate 22.

When assembling, the first hinge shaft 41 of the hinge 40 is mounted in the first hinge hole 213 on the short side plate 21, and the second hinge shaft 42 of the hinge 40 is mounted in the second hinge hole 225 on the short side plate 22, and thus the first short side plate 21 and the second short side plate 22 are connected by the hinge 40. The first hinge shaft 41 is rotatable in the first hinge hole 213, and the second hinge shaft 42 is rotatable in the second hinge hole 225, so that the short side plate 21 and the short side plate 22 can be folded over each other by the rotation of the first hinge shaft 41 and the second hinge shaft 42.

Figure 1A:
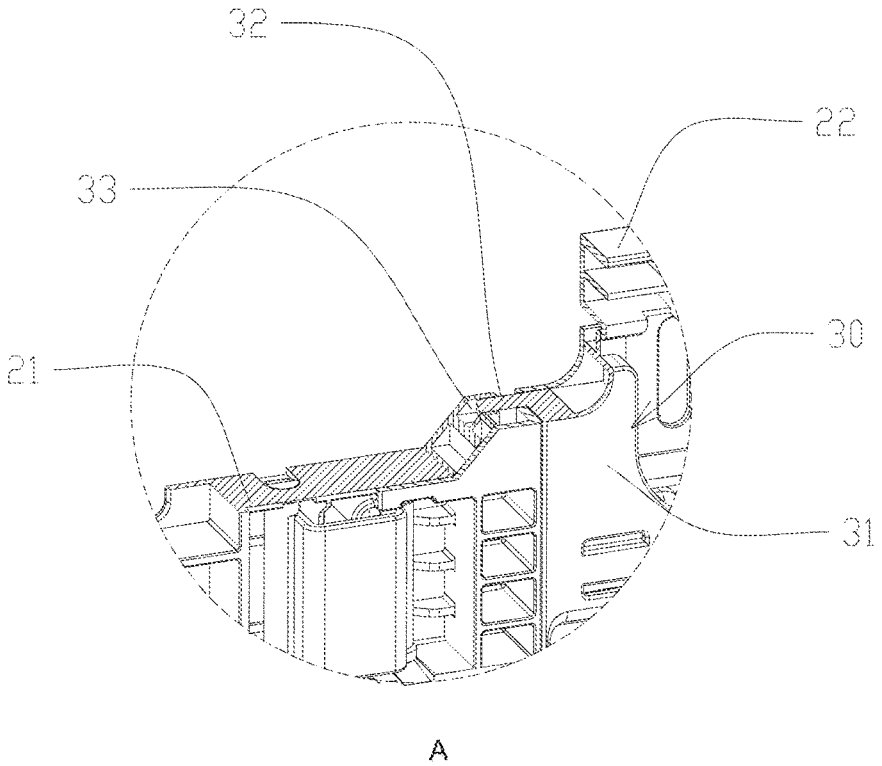
FIGS. 1A-1B are enlarged views of part A in FIG. 1.
Figure 1B:
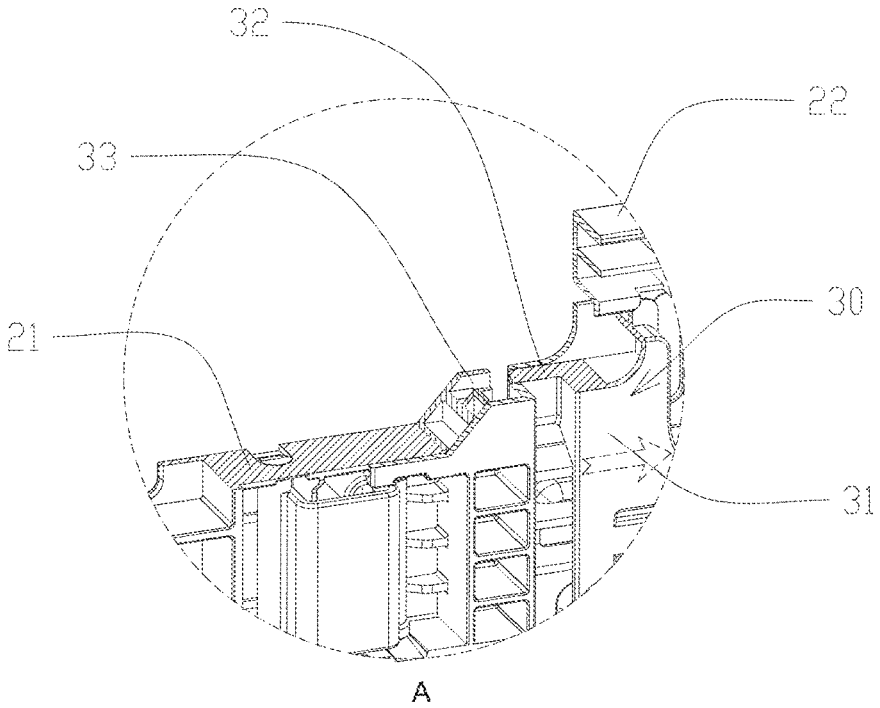

FIGS. 1A-1B are enlarged views of part A in FIG. 1, in which FIG. 1A shows a state in which two short side plates are locked to each other, and FIG. 1B shows an unlocked state. As shown in FIGS. 1-1B, when the first short side plate 21 and the second short side plate 22 are engaged with each other, the first engaging portion 211 is engaged with the second engaging portion 221, and the hinge mounting portion 223 protrudes into the opening 212. The operating member 31 is mounted on the second short side plate 22, and the protrusions 313 at both ends thereof are restricted by the baffles 227 in the direction vertical to the second short side plate 22, and the lugs 311 are snapped into the lug mounting hole 226. The locking tongue 32 is received in the locking tongue mounting hole 224 and extends into the locking hole 33 so as to lock the short side plate 21 and the short side plate 22 to each other.

As shown in FIG. 1A, when the operating member 31 is driven to slide rearward so that the tongue 32 is driven to withdrawn from the locking hole 33, the first short side plate 21 and the second short side plate 22 are unlocked from each other. As the first engaging portion 211 and the second engaging portion 221 can only limit the position of the first short side plate 21 and the second short side plate 22 in a direction parallel to the short side plate, the first short side plate 21 and the second short side 22 may be folded over each other when unlocked so as to be folded into a folded state as shown in FIG. 3.

Figure 2A:
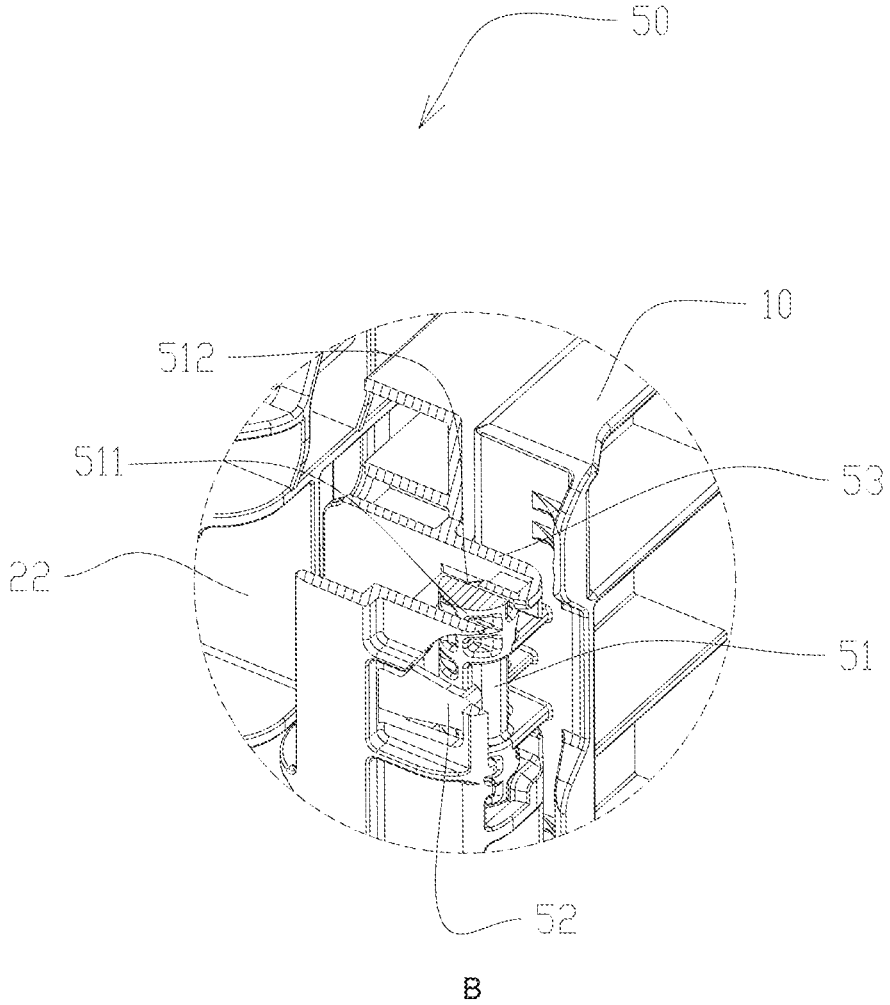
FIGS. 2A-2C are enlarged views of part B in FIG. 2.
Figure 2B:
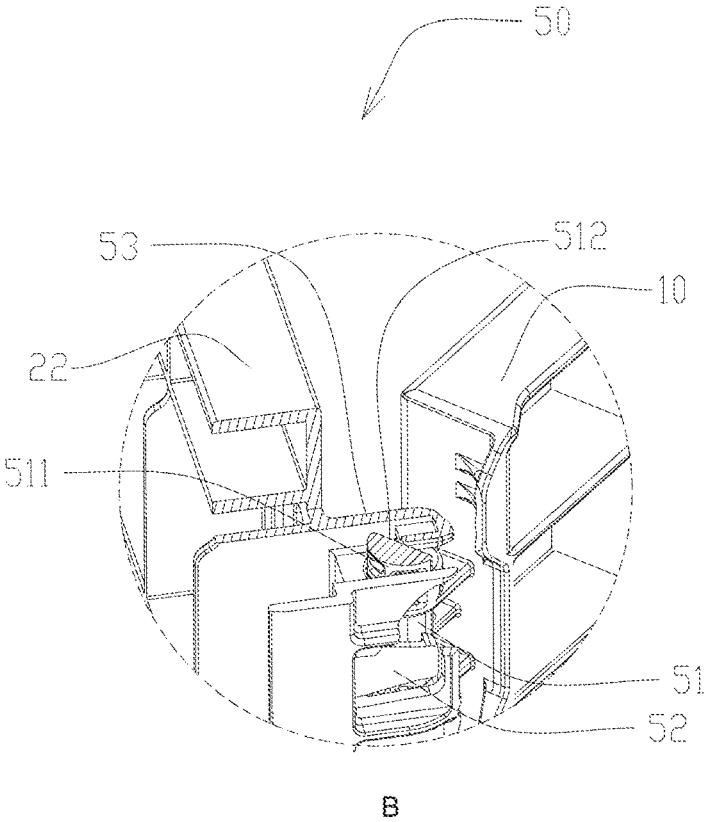
Figure 2C:
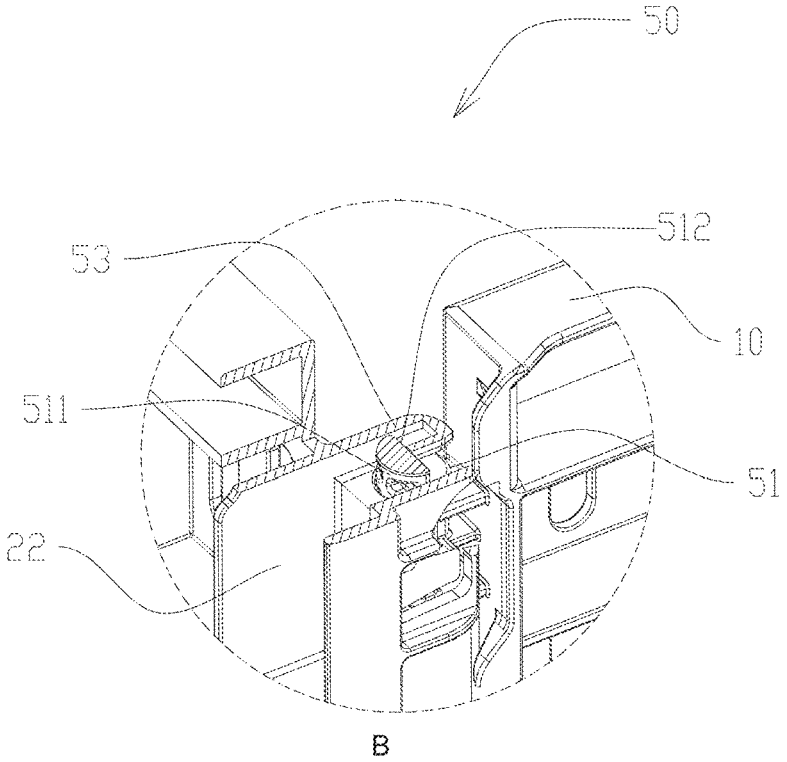
Figure 4A:
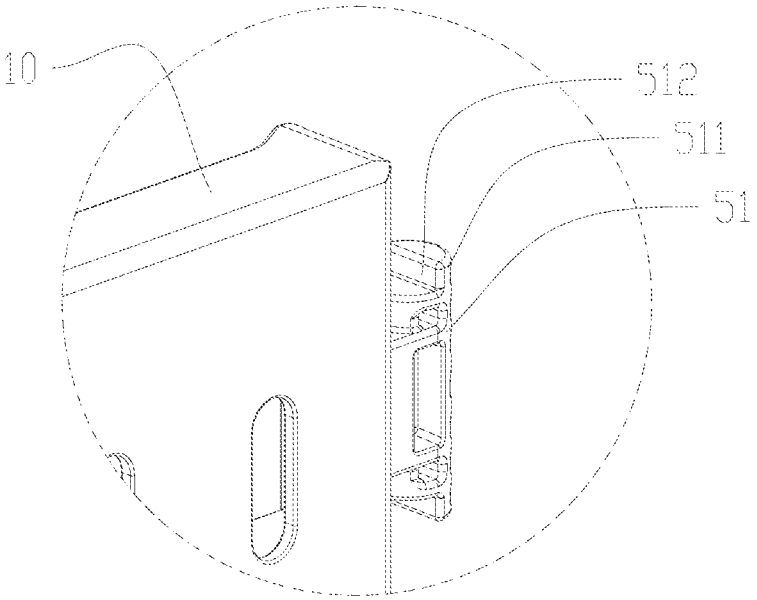
FIG. 4A is an enlarged view of part C in FIG. 4.
Figure 4B:
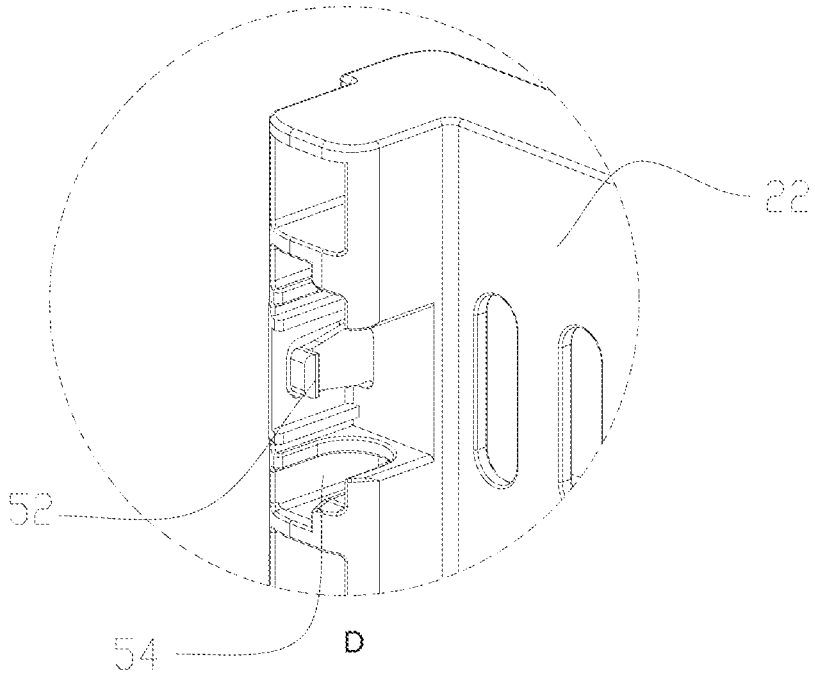
FIG. 4B is an enlarged view of part D in FIG. 4.

FIGS. 2A to 2C are enlarged views of part B of FIG. 2, and FIGS. 4A to 4B are enlarged views of parts C and D of FIG. 4, respectively. As shown in FIGS. 2A-2C and FIGS. 4A-4B, the adjacent long side plate 10 and the short side plate 22 are connected by a second hinge 50, which includes a long side plate hinge shaft 51 provided on the long side plate 10 and hooks 52 and protrusions 53 provided on the short side plate 22. The side surfaces of the upper end of the long side plate hinge shaft 51 include a curved portion 511 and a planar portion 512. When the long side plate 10 is perpendicular to the short side plate 22, the flat portion 512 is perpendicular to the end of the protrusion 53, and when the long side plate 10 is folded relative to the short side plate 22, the flat portion 512 is parallel to the end of the protrusion 53. The hook 52 is used to cooperate with side surface of the long side plate hinge shaft 51.

When being unlocked, the operating member 31 is laterally moved, that is, the operating member 31 is moved in the direction parallel to the short side plate 22, the locking tongue 32 is separated from the locking hole of the short side plate 31, and the short side plates 21, 22 are folded inwards. The opposite short side plates 21, 22 are operated to fold in this way accordingly and finally the side plates are folded into a flat structure as shown in FIG. 3.

During installation, the long and short side plates are parallel to each other, and the long side plate hinge shaft 51 is embedded in the short side plate hinge mounting groove 54. The inclined guide of the long side plate hinge shaft 51 and the hook 52 urges the hook 52 to retreat outward, and the hook 52 locks the long side plate hinge shaft 51 in the hinge groove, and at the same time the short side plate rotates to 90 degree with respect to the long side plate, the hinge shaft protrusion cooperates with the short side plate protrusion to limit the mutual disengagement of the long side plate and the short side plate when they are substantially vertical.

The frame according to another embodiment of the present invention will be described in detail with reference to FIGS. 6-7B. The main difference between the present embodiment and the previous embodiment is that, in this embodiment, unlocking is achieved by rotating the handle, and in the previous embodiment, unlocking is achieved by sliding the operating member. Therefore, in the place that is not described in detail in this embodiment, refer to the relevant description of previous embodiment.

Figure 6:
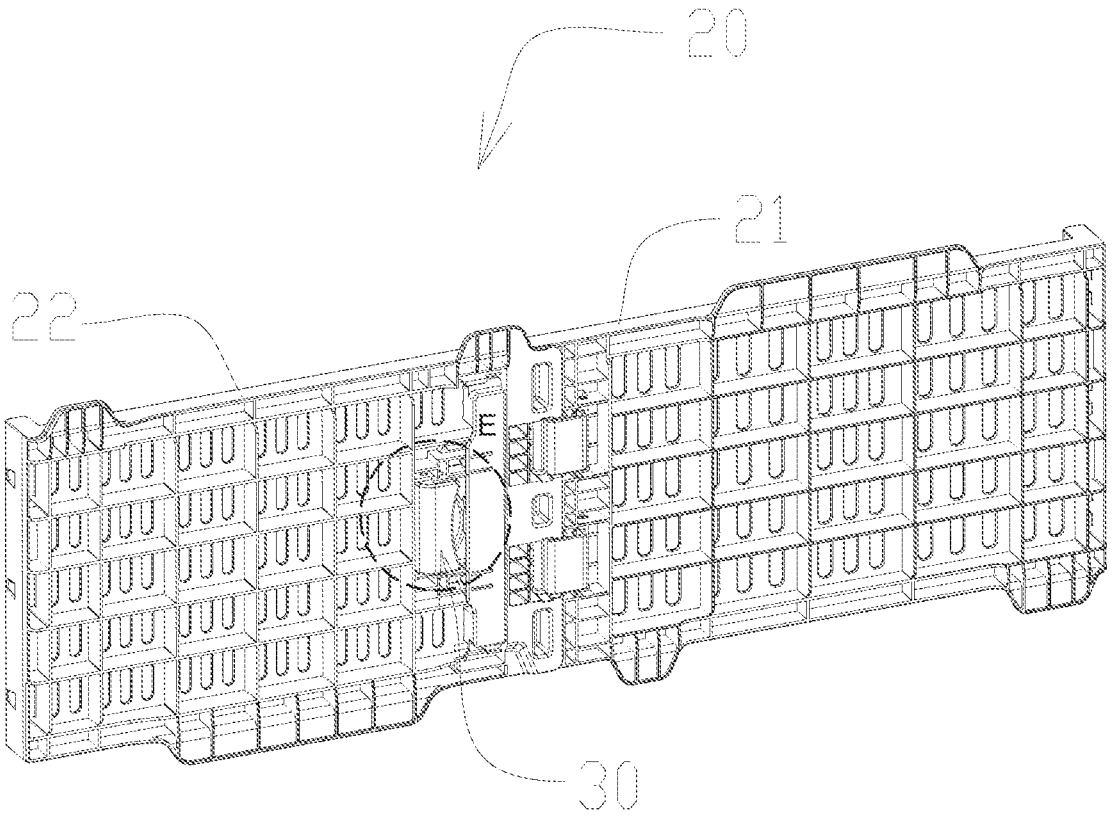
FIG. 6 is a perspective view of a group of short side plates according to another embodiment of the present invention.
Figure 6A:
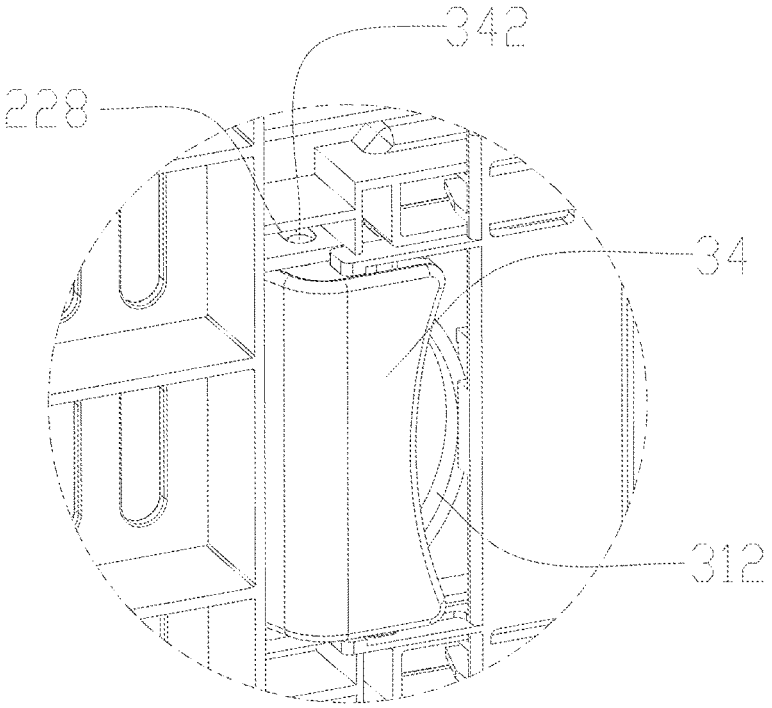
FIGS. 6A-6B are enlarged views of part E in FIG. 6.
Figure 6B:
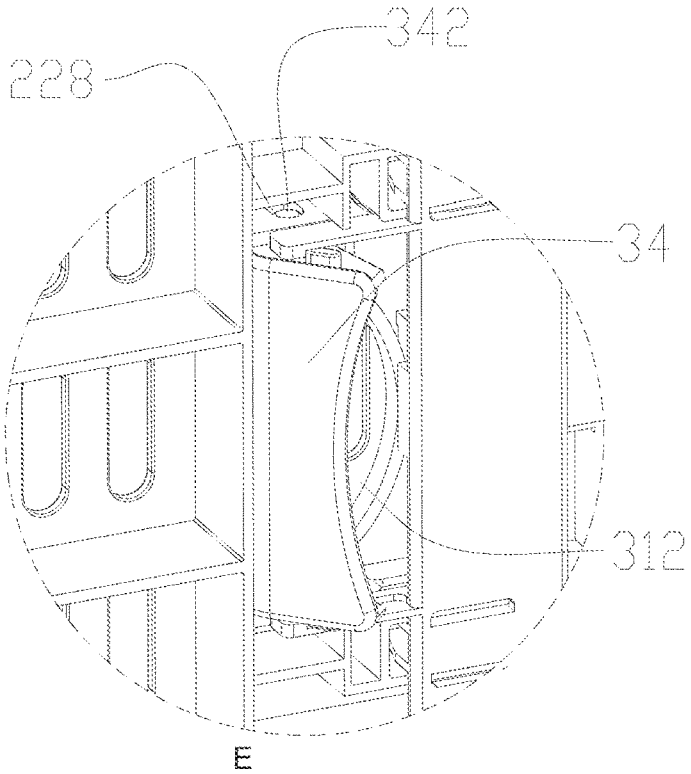
Figure 7A:
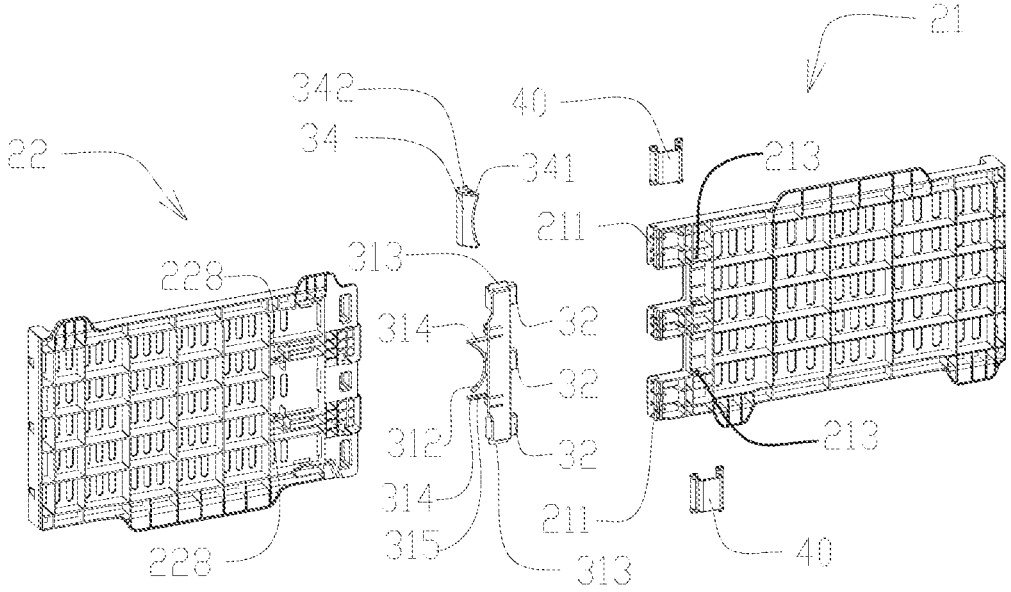
FIGS. 7A and 7B are exploded perspective views of a group of short side plates in FIG. 6.

FIG. 6 is a perspective view of a group of short side plates 20 of another embodiment, wherein the short side plate 21 and the short side plate 22 are in a locked state. FIGS. 6A-6B are enlarged views of the part E in FIG. 6, and FIG. 7A is an exploded perspective view of a group of short side plates 20 in FIG. 6. FIG. 7B is an enlarged view of a portion of FIG. 7A.

Figure 7B:
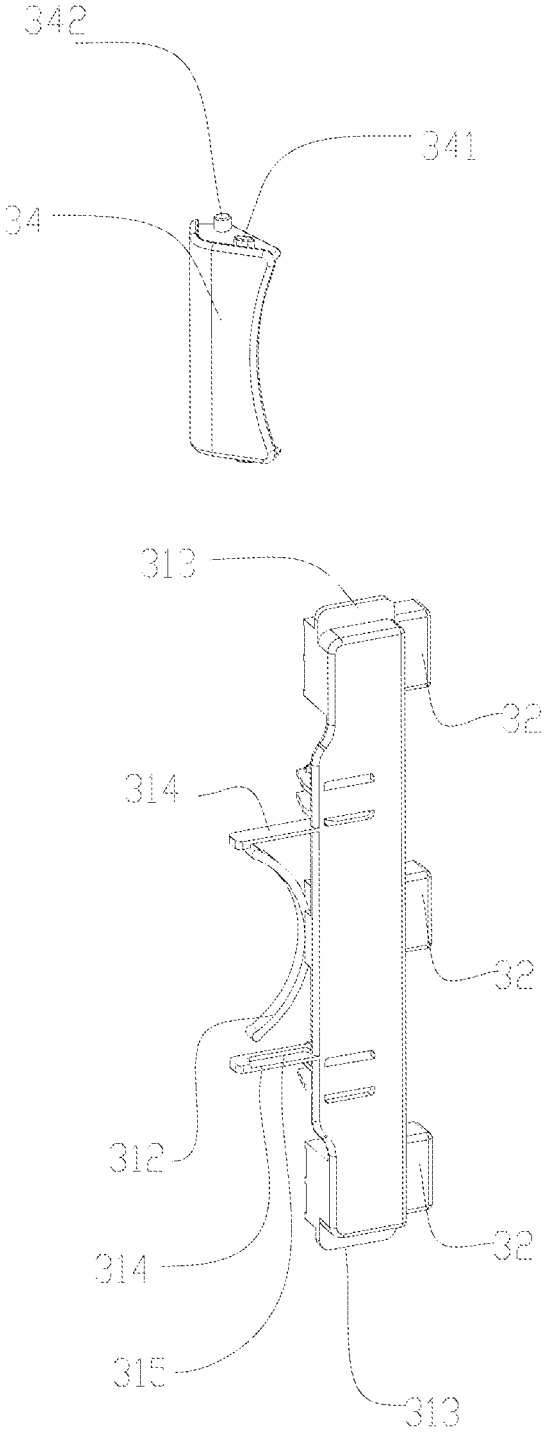

As shown in FIGS. 6-7B, the operating member 31A further includes a handle 34. Both ends of the handle 34 are provided with a limiting portion 341 respectively. The end surface of the limiting portion 341 is provided with a rotating shaft 342. The second short side plate 22 is provided with a shaft mounting hole 228 for receiving the rotating shaft 342, and two protruding blocks 314 are integrally protruded from the side surface of the operating member 31A. The protruding block 314 is provided with a sliding slot 315 engaged with the limiting portion 341, so that the handle 34 rotatably drive the locking tongue 32 through the cooperation of the rotating shaft 342 and the sliding slot 315.

Similar to the first embodiment, the operating member 31 further includes a return spring 312, which is disposed behind the locking tongue 32.

When unlocking, the handle 34 is turned outwards, and the rotating shaft 342 rotates in the shaft mounting hole 228 of the short side plate 22, and the limiting portion 341 is back against the sliding slot 315, so that the locking tongue 32 force the return spring 312 to yield under dragging of the limiting portion 341, and the locking tongue 32 is eventually unlocked by moving toward the end of the short side plate 22.

Figure 8:
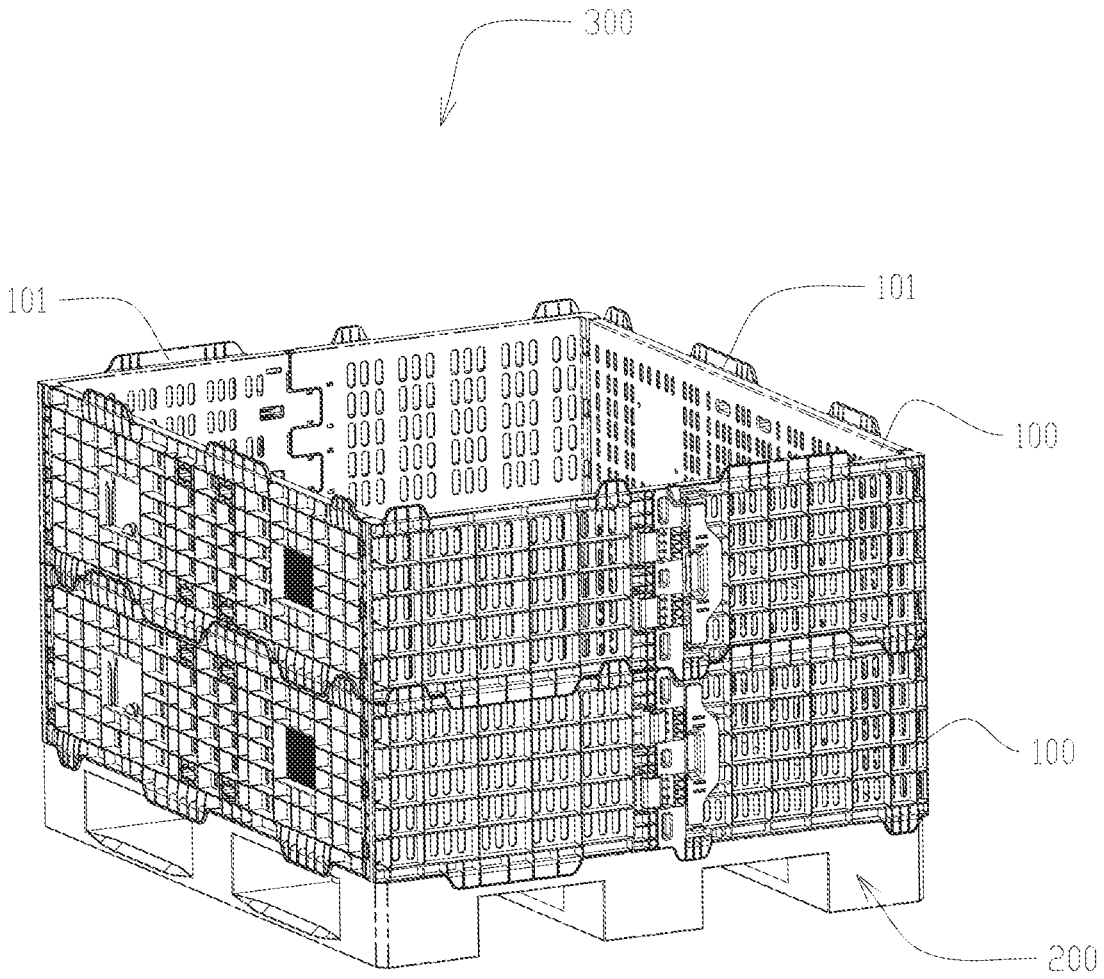
FIG. 8 is a perspective view of a pallet coaming box according to the present invention.

FIG. 8 is a perspective view of the pallet coaming box of the present invention. As shown in FIG. 8, according to another aspect of the present invention, a pallet coaming box 300 is also provided. The pallet coaming box 300 includes the above-mentioned frame 100 and the pallet 200. The frame 100 is mounted on the pallet 200. Preferably, a plurality of limiting flanges 101 are provided on the frame 100, and a plurality of frames 100 can be stacked on the pallet 200 through the limiting flanges 101.

The frame of the present invention is provided with unlocking devices which may be manually operated at the hinges of two short side plates. When the frame is unfolded and used, the adjacent short side plates can be kept relatively parallel to minimize the deformation of the side plates which are subjected to the tension of the goods, and also increase the effectiveness and reliability of the support and limit when another frame is stacked thereon. During use, the side plates are easy to fold, and the engaging portion of the short side plate can effectively limit the displacement of the side plates when being unfolded, so as to minimize the outwards deformation of the side plates due to the seizure, and improve the reliability of container for loading and transportation or stacking on one another.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

What is claimed is:

1. A frame comprising:

two long side plates and two groups of short side plates opposite thereto, each group of short side plates comprising two short side plates, the two short side plates are capable of being folded over each other, and the long side plates and the short side plates that are next to each other are capable of being folded over one another, wherein one of the two short side plates is provided with at least one first engaging portion, and the other of the two short side plates is provided with a second engaging portion matching the first engaging portion, wherein the two short side plates include a first short side plate and a second short side plate, wherein the first engaging portion and the second engaging portion are configured to only limit the position of the first short side plate and the second short side plate in a position parallel to the two short side plates in an open state of the frame, and a locking device comprising an operating member, a locking member, and a locking structure matching the locking member is further provided between the two short side plates, wherein the locking member is mounted on one of the short side plates, the locking structure is provided on the other one of the short side plates, and the operating member operatively drives the locking member to mutually lock or separately unlock with the locking structure so as to lock or unlock the two short side plates, wherein the operating member comprises lugs and a return spring disposed behind a locking tongue, and the second short side plate is provided with lug mounting holes that cooperate with the lugs; the operating member and the locking tongue are mounted on the second short side plate by snapping the lugs into the lug mounting holes and inserting the locking tongue into a locking tongue mounting hole, wherein the adjacent long side plate and the short side plate are connected by a hinge, which comprises a long side plate hinge shaft provided on the long side plate and hooks and protrusions provided on the short side plate; upper end portion of the long side plate hinge shaft has a side surface including a curved surface portion and a planar portion, and when the long side plate is perpendicular to the short side plate, the planar portion is perpendicular to end of the protrusions, and when the long side plate is folded relative to the short side plate, the planar portion is parallel to the end of the protrusions, and the hook is used to cooperate with side surface of the long side plate hinge shaft.

2. The frame of claim 1, wherein one of the two short side plates is provided with a plurality of the first engaging portions spaced apart from one another, and the other of the two short side plates is provided with a plurality of the second engaging portions; wherein a hinge mounting portion is provided between the second engaging portions, and the hinge mounting portion is inserted between two first engaging portions, and the locking member is provided at the same height as the second engaging portions.

3. The frame of claim 1, wherein the locking member is the locking tongue, the locking structure is a locking hole, and the operating member operatively drive the locking tongue to extend into or exit from the locking hole, so as to lock or unlock the two short side plates.

4. The frame of claim 3, wherein the first engaging portion and the locking hole are provided on the first short side plate, and the second engaging portion is provided on the second short side plate, and the operating member is movably mounted on the second short side plate.

5. The frame of claim 4, wherein a recess is provided on an inner side of the second short side plate, and the second engaging portion is provided in the recess and extend integrally toward inside of the frame from the recess, and the locking tongue mounting hole is formed on a side wall of the recess facing the first short side plate.

6. The frame of claim 4, wherein the first short side plate and the second short side plate are connected by a hinge, and a plurality of tongue mounting hole are provided along height direction of the second short side plate, and a hinge mounting portion is provided between each two of the locking tongue mounting holes.

7. The frame of claim 6, wherein the operating member is integrally formed with the locking tongue.

8. The frame of claim 4, wherein the operating member further includes a handle, and both ends of the handle are provided with a limiting portion, and an end surface of the limiting portion is provided with a rotating shaft; the second short side plate is provided with a shaft mounting hole for accommodating the rotating shaft, and the side of the operating member integrally protrudes two protruding blocks provided with a slot matched with the limiting portion, so that the locking tongue is rotationally driven by the handle through cooperation of the rotating shaft and the slot.

9. A pallet coaming box, comprising a pallet and the frame of claim 1, wherein the frame is mounted on the pallet.

10. A frame comprising:

two long side plates and two groups of short side plates opposite thereto, each group of short side plates comprising two short side plates, the two short side plates include a first short side plate and a second short side plate and are capable of being folded over each other, and the long side plates and the short side plates that are next to each other are capable of being folded over another, wherein the position of the two short side plates is configured to be only limited in a position parallel to the two short side plates in an open state of the frame, wherein a locking device comprising an operating member, a locking member and a locking structure cooperating with said locking member is provided between the two short side plates; the locking member is mounted on one of the short side plates, and the locking structure is disposed on the other of the short side plates, and the operating member operatively drives the locking member to mutually lock or separately unlock with the locking structure so as to lock or unlock the two short side plates, wherein the operating member comprises lugs and a return spring disposed behind a locking tongue, and the second short side plate is provided with lug mounting holes that cooperate with the lugs; the operating member and the locking tongue are mounted on the second short side plate by snapping the lugs into the lug mounting holes and inserting the locking tongue into a locking tongue mounting hole, wherein the adjacent long side plate and the short side plate are connected by a hinge, which comprises a long side plate hinge shaft provided on the long side plate and hooks and protrusions provided on the short side plate; upper end portion of the long side plate hinge shaft has a side surface including a curved surface portion and a planar portion, and when the long side plate is perpendicular to the short side plate, the planar portion is perpendicular to end of the protrusions, and when the long side plate is folded relative to the short side plate, the planar portion is parallel to the end of the protrusions, and the hook is used to cooperate with side surface of the long side plate hinge shaft.

* * * * *